US007531082B2

(12) United States Patent
Mukherjee et al.

(10) Patent No.: US 7,531,082 B2
(45) Date of Patent: May 12, 2009

(54) HIGH CONVERSION HYDROPROCESSING USING MULTIPLE PRESSURE AND REACTION ZONES

(75) Inventors: Ujjal K. Mukherjee, Montclair, NJ (US); Art Dahlberg, Benicia, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 405 days.

(21) Appl. No.: 11/072,474

(22) Filed: Mar. 3, 2005

(65) Prior Publication Data

US 2006/0196809 A1 Sep. 7, 2006

(51) Int. Cl.
*C10G 45/00* (2006.01)

(52) U.S. Cl. ..... 208/57; 208/58; 208/59; 208/89; 208/107; 208/210

(58) Field of Classification Search ..... 208/57, 208/89, 107, 210, 58, 59
See application file for complete search history.

(56) References Cited

U.S. PATENT DOCUMENTS 6,623,624 B2 9/2003 Cash et al.
6,783,660 B2 8/2004 Dahlberg et al.
6,787,025 B2 9/2004 Mukherjee et al.
6,797,154 B2 9/2004 Mukherjee et al.

*Primary Examiner*—Glenn Caldarola
*Assistant Examiner*—Prem C. Singh
(74) *Attorney, Agent, or Firm*—Penny L. Prater; Nirav Patel

(57) ABSTRACT

In the refining of crude oil, hydroprocessing units such as hydrotreaters and hydrocrackers are used to remove impurities such as sulfur, nitrogen, and metals from the crude oil. They are also used to convert the feed into valuable products such as naphtha, jet fuel, kerosene and diesel. The current invention provides very high to total conversion of heavy oils to products in a single high-pressure loop, using multiple reaction stages. A hot high pressure separator is located between the first and second reaction stages. Overhead from the separator is treated in a distillate upgrader, which may operate in co-current or countercurrent mode.

16 Claims, 3 Drawing Sheets

HIGH CONVERSION HYDROPROCESSING USING MULTIPLE PRESSURE AND REACTION ZONES

FIELD OF THE INVENTION

This invention is directed to hydroprocessing, and more particularly to multistage hydroprocessing.

BACKGROUND OF THE INVENTION

This process is directed to hydroprocessing, preferably by hydrocracking heavy hydrocarbon material boiling in the vacuum gas oil range to produce middle distillates at very high selectivity, and to upgrade lower-value distillates by hydrotreating. The concept includes many innovations which would allow the refiner to obtain yields similar to those of a multistage hydrocracker with the economics of a single stage, once-through unit.

Previous designs for hydroprocessing vacuum gas oils or other hydrocarbon materials boiling in a range of 392° F. or greater include:

- Straight forward single stage once through design. Conversion ranges from 20% to 80%. The amount of bottoms produced is greater than or equal to 20%.
- Single stage recycles. Conversion ranges from 90% to 99% conversion. The amount of bottoms produced is less than or equal to 10%. Recycle liquid operation can result in complications, however.
- Multistage recycle results in higher cost than single stage once through or single stage recycle. It does provide, however, the highest liquid yield and most flexibility. Conversion is from 95% to 100%. Bottoms produced are less than 5%.
- Split-feed injection in cases where external distillate feeds are employed.

None of these processes can readily upgrade external feeds (raw feeds from outside the hydroprocessing unit), unless they go through captive process loop.

SUMMARY OF THE INVENTION

This invention is designed to obtain yields similar to those obtained with multistage recycle but at a much lower capital investment. It is intended to simultaneously upgrade external, low-value distillates while hydrocracking feeds boiling in the vacuum gas oil range.

The configuration involves a once-through liquid hydroprocessing unit having at least two reactors. One is preferably for hydrotreating, and one is preferably for hydrocracking in a clean environment at lower pressure. Between the first and second reactors is a very hot high pressure separator which flashes first reactor product distillate overhead to a distillate upgrader.

Advantages of this invention include:

(1) Lower capital cost than found in earlier designs because of:
  (a) lower pressure in hydrocracking reactor and distillates upgrader;
  (b) a clean environment for hydrocracking in subsequent reactors;
  (c) a smaller overall catalyst volume is required; and
  (d) amount of major equipment (pumps, furnaces, compressors, etc.) is minimized.

(2) Higher conversion results, relative to a typical single stage once through hydroprocessing unit. Subsequent reactors operate in a clean environment and can accomplish high conversions at much lower temperatures than the bottoms beds of a single stage once through hydroprocessing unit.

(3) Overcracking of distillates is minimized due to the very hot high pressure separator following the first reactor. In this separator the bulk of the distillates are removed overhead and thus are prevented from reaching the hydrocracking reactor. This innovation leads to high distillate selectivity (distillate yield/conversion). The distillate selectivity approaches the 95% achievable in a recycle unit having two or more stages.

(4) Split feed injection with segregated reaction zones. Upgrading of external distillates occurs at the same time as vacuum gas oil hydrocracking without separate fractionation zones. This concept differs from earlier split feed designs in the lower operating pressure employed at the point of split feed injection. Furthermore, the feed is injected at different points than those used in previous inventions.

(5) Lower consumption of $H_2$ and lower catalyst volume because the reaction zones are optimized for their functions. (HDT of VGO at high pressure, recovery/upgrading of distillates, HCR of VGO bottoms provides a clean environment).

The development of this invention has been promoted by the following observations:

(1) Hydrotreating of material boiling in the vacuum gas oil range is much more effective at higher hydrogen pressure than lower hydrogen pressure.

(2) Hydrocracking of bottoms from a hydrotreated vacuum gas oil feed can occur at 50° F. to 00° F. lower temperature in a clean environment than in the bottoms beds of a single stage once through process.

(3) Diesel overlap will crack when mixed in with vacuum gas oil in a hydrocracker.

(4) A noble metal zeolite hydrocracking catalyst will function very well in the second reactor or subsequent reactor. A base metal zeolite hydrocracking catalyst can also be used.

(5) Calculations indicate this process configuration can accomplish >90% conversion with 94% to 96% selectivity to 250° F. to 700° F. distillates produced from a straight run vacuum gas oil.

The invention is summarized as follows:

An integrated hydroprocessing method having at least two stages, each stage further comprising at least one reaction zone, said method comprising the following steps:

(a) combining an oil feed with a hydrogen-rich gas stream to form a feedstock;

(b) passing the feedstock of step (a) to a reaction zone of the first stage, which is maintained at conditions sufficient to effect a boiling range conversion, and contacting it with hydroprocessing catalyst, thereby creating a hydroprocessed effluent;

(c) passing the effluent of step (b), following pressure reduction, to a very hot separator maintained at high pressure, where it is separated into an overhead fraction and a bottoms fraction;

(d) passing the overhead fraction of step (c) to a distillate upgrader which contains at least one zone of hydroprocessing catalyst and is maintained at conditions sufficient to effect a boiling range conversion, thereby creating an upgraded effluent;

(e) passing the bottoms fraction of step (c) to a reaction zone of the second stage, which is maintained at conditions sufficient to effect a boiling range conversion, and contacting it with hydroprocessing catalyst thereby creating a second hydroprocessed effluent;

(f) combining the upgraded effluent of step (d) with the second hydroprocessed effluent of step (e), the combined stream then entering a hot separator maintained at high pressure, in which the combined stream is separated into an overhead fraction and a bottoms fraction, the bottoms fraction proceeding to fractionation;

(g) passing the overhead fraction of step (f) to a cold separator, where it is separated into an overhead fraction comprising hydrogen and light gases, and a bottoms fraction comprising sour water.

BRIEF DESCRIPTION OF THE FIGURES

FIG. 2 illustrates catalyst temperature vs. conversion and FIG. 3 compares middle distillate yield vs. conversion.

DETAILED DESCRIPTION OF THE INVENTION

Description of the Preferred Embodiment

Figure 1:
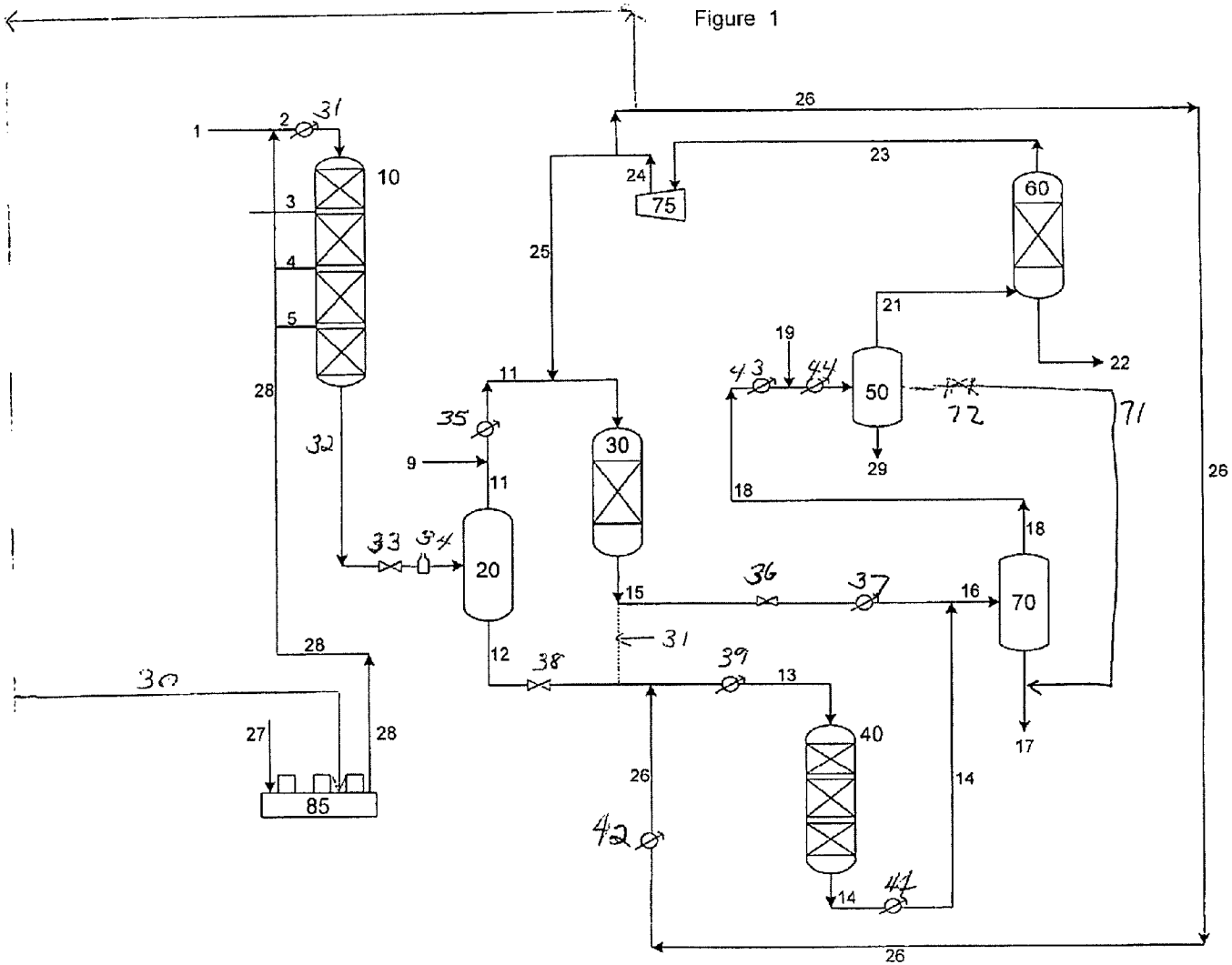
FIG. 1 illustrates the multistage recycle process of the instant invention.

FIG. 1 illustrates feed entering the process through stream 1 and being combined with hydrogen in stream 28 to form stream 2. Hydrogen in stream 28 is prepared by compression of hydrogen in makeup compressor 85. Hydrogen enters compressor 85 through stream 27. The invention includes an option to compress a stream 30 of recycle gas in the last stage of compressor 85 to meet the gas to oil ratio in reactor 10, when required.

Stream 2 is heated, as depicted by exchanger 31, prior to entering the first stage hydroprocessing unit, vessel 10. Vessel 10 is preferably operated as a hydrotreater. The feed flows downward through one or more beds of catalyst. Streams 3, 4, and 5 depict interbed hydrogen quench.

Hydrotreated effluent exits vessel 10 through stream 32 and is reduced in pressure (valve 33) to that required for hydrocracking in a clean environment. The effluent is heated in furnace 34 to approximately 825° F. in order to disengage the maximum material in very hot high pressure separator 20. This separator functions as a simple flash drum, separating diesel and lighter fractions from heavier materials without the use of hydrogen stripping. Hydrogen stripping is relatively ineffective at hydrocracking pressures. Stream 11, containing diesel and lighter materials, exits vessel 20 overhead. External feeds in the middle distillate boiling range, as well as fractionation recycle, are represented by stream 9 and are combined with stream 11. Stream 11 is heated in exchanger 35 and may be combined with hydrogen in stream 25 prior to entering a distillate upgrader, vessel 30, in the case of co-current flow. Flow in vessel 30 may be co-current or counter-current. Countercurrent flow may be preferred if aromatics saturation is desired. The amount of aromatics permitted in the ultra-low sulfur diesel being manufactured (ULSD) may affect whether co-current or counter-current flow is used. In the case of countercurrent flow, hydrogen is added below the catalyst beds and is directed upward. The catalyst in the bed or beds of vessel 30 is preferably hydrotreating catalyst, but hydrocracking catalyst may be used if fractionation recycle is being treated.

The bottoms effluent of vessel 30 exits through stream 15. Material from stream 15 may be passed to stream 12 as feed to the hydrocracker, vessel 40, when necessary. The dotted line depicts this. The upgraded diesel effluent in stream 15 is reduced in pressure (valve 36), cooled (exchanger 37), combined with the effluent stream (stream 14) from vessel 40 (in which second stage hydrocracking preferably occurs) to become stream 16. Stream 16 is passed to the hot high pressure separator 70, where it is separated into an overhead stream 18 and a bottoms stream 17. Bottoms stream 17 is sent to fractionation. Overhead stream 18 is cooled prior to entering cold high pressure separator 50 by passage through exchangers 43 and 44, as well as by water injection through stream 19. Sour water exits cold high pressure separator through stream 29. Stream 71 goes to fractionation. It may be reduced in pressure using valve 72. Overhead gaseous material in stream 21 enters amine absorber, vessel 60 at the bottom and flows upward, as lean amine moves downward, absorbing hydrogen sulfide. Rich amine exits vessel 60 through stream 22. Stream 23, comprising primarily hydrogen, exits overhead through stream 23. Stream 23 is compressed in compressor 75, becoming stream 24. Stream 24 is divided into streams 25 and 26. Stream 26 is heated in exchanger 42 before combining with stream 12 to form stream 13.

The bottoms effluent of vessel 20 exits through stream 12. Valve 38 is a level control valve. Stream 12 may be combined with material in stream 15, along with hydrogen in stream 26 then is heated in exchanger 39. Streams 12 and 15 may be combined when naphtha or jet fuel is the preferred product. Recycle stream 31 may be added to stream 15 when very high conversion levels are required. Stream 13 exits exchanger 39 and enters vessel 40. Second stage hydrocracking preferably occurs in vessel 40, which contains one or more beds of hydrocracking catalyst. Effluent in stream 14 is cooled in exchanger 41 before being combined with stream 16.

Feeds

A wide variety of hydrocarbon feeds may be used in the instant invention.

Typical feedstocks include any heavy or synthetic oil fraction or process stream having a boiling point above 392° F. (200° C.). Such feedstocks include vacuum gas oils (VGO), heavy coker gas oil (HCGO), heavy atmospheric gas oil (AGO), light coker gas oil (LCGO), visbreaker gas oil (VBGO), demetallized oils (DMO), vacuum residua, atmospheric residua, deasphalted oil, Fischer-Tropsch streams, Light Cycle Oil and other FCC product streams.

Products

The process can be used over a broad range of applications as shown in the Table 1.

TABLE 1

| Oil Feed | Catalyst System | Operating Conditions | Products |
|---|---|---|---|
| VGO | Stage 1 - | Stage I: | Maximum Diesel |
| HCGO | Hydrotreating + Hydrocracking | P: 1000-3000 psig | Maximum Jet + Diesel |
| DAO | | LHSV = 0.3-4.0 | Maximum Naphtha |
| VBGO | | T: 600° F.-850° F. | |
| | Stage2 - Hydrocracking | Stage 2: | |

TABLE 1-continued

| Oil Feed | Catalyst System | Operating Conditions | Products |
|---|---|---|---|
| | | P: 1000-3000 psig<br>LHSV = 0.5-5.0<br>T: 500° F.-800° F. | |
| AGO, LCO, LCGO | Stage 1 -<br>Hydrotreating + Hydrocracking | Stage I:<br>P: 1000-3000 psig<br>LHSV = 0.5-4.0<br>T: 600° F.-850° F. | Maximum Diesel<br>Maximum Jet + Diesel<br>Maximum Naphtha |
| | Stage2 - Hydrocracking<br>or<br>Stage 2 -<br>Base Metal Hydrocracking<br>or<br>Stage 2 - Aromatic Saturation<br>(Noble-metal) | Stage 2:<br>P: 1000-3000 psig<br>LHSV = 0.5-5.0<br>T: 500° F.-750° F. | |

The process of this invention is especially useful in the production of middle distillate fractions boiling in the range of about 250° F. to 700° F. (121° C. to 371° C.). A middle distillate fraction is defined as having an approximate boiling range from about 250° F. to 700° F. At least 75 vol. %, preferably 85 vol. % of the components of the middle distillate has a normal boiling point of greater than 250° F. At least about 75 vol. %, preferably 85 vol. % of the components of the middle distillate has a normal boiling point of less than 700° F. The term "middle distillate" includes the diesel, jet fuel and kerosene boiling range fractions. The kerosene or jet fuel boiling point range refers to the range between 280° F. and 525° F. (38° C. to 274° C.). The term "diesel boiling range" refers to hydrocarbons boiling in the range from 250° F. to 700° F. (121° C. to 371° C.).

Gas streams or naphtha may also be produced in the process of this invention. Gas streams or naphtha normally boils in the range below 400° F. (204° C.), or from $C_5$ to 400° F. (204° C.). Boiling ranges of various product fractions recovered in any particular refinery will vary with such factors as the characteristics of the crude oil source, local refinery markets and product prices.

Conditions

A hydroprocessing condition is a general term which refers primarily in this application to hydrocracking or hydrotreating.

Hydrotreating conditions include a reaction temperature between 400° F. to 900° F. (204° C. to 482° C.), preferably 650° F. to 850° F. (343° C. to 464° C.); a pressure between 500 to 5000 psig (pounds per square inch gauge) (3.5 to 34.6 MPa), preferably 1000 to 3000 psig (7.0 to 20.8 MPa): a feed rate (LHSV) of 0.5 to 20 hr-1 (v/v); and overall hydrogen consumption 300 to 2000 SCF per barrel of liquid hydrocarbon feed (63.4 to 356 $m^3/m^3$ feed. The second stage hydrotreating reactor is operating at a lower pressure than the first stage reactor, the VGO hydrotreater or moderate severity hydrocracker.

Typical hydrocracking conditions (which may be found in stage 1 or stage 2) include a reaction temperature of from 400° F. to 950° F. (204° C. to 510° C.) preferably 650° F. to 850° F. (343° C. to 454° C.). Reaction pressure ranges from 500 to 5000 psig (3.5 to 4.5 MPa), preferably 1500 to 3500 psig (10.4 to 24.2 MPa). LHSV ranges from 0.1 to 15 hr-1 (v/v), preferably 0.25 to 2.5 hr hydrogen consumption ranges from 500 to 2500 SCF per barrel of liquid hydrocarbon feed (89.1 to 445 $m^3H_2/m^3$ feed).

Catalyst

A hydroprocessing zone may contain only one catalyst, or several catalysts in combination.

The hydrocracking catalyst generally comprises a cracking component, a hydrogenation component and a binder. Such catalysts are well known in the art. The cracking component may include an amorphous silica/alumina phase and/or a zeolite, such as a Y-type or USY zeolite. Catalysts having high cracking activity often employ REX, REY and USY zeolites. The binder is generally silica or alumina. The hydrogenation component will be a Group VI, Group VII, or Group VIII metal or oxides or sulfides thereof, preferably one or more of molybdenum, tungsten. cobalt, or nickel, or the sulfides or oxides thereof. If present in the catalyst, these hydrogenation components generally make up from about 5% to about 40% by weight of the catalyst. Alternatively, platinum group metals, especially platinum end/or palladium, may be present as the hydrogenation component, either alone or in combination with the base metal hydrogenation components molybdenum, tungsten, cobalt, or nickel. If present, the platinum group metals will generally make up from about 0.1% to about 2% by weight of the catalyst.

If aromatic saturation is particularly desired, a preferred catalyst has a crystalline molecular sieve material component and a Group VIII noble metal component. The crystalline molecular sieve material component is a large pore faujasite structure having an alpha acidity of less than 1, preferably less than 0.3. Zeolite USY is the preferred crystalline molecular sieve material component.

Hydrotreating catalyst, if used, will typically be a composite of a Group VI metal or compound thereof, and a Group VIII metal or compound thereof supported on a porous refractory base such as alumina. Examples of hydrotreating catalysts are alumina supported cobalt-molybdenum, nickel sulfide, nickel-tungsten, cobalt-tungsten and nickel-molybdenum. Typically, such hydrotreating catalysts are presulfided.

EXAMPLES

TABLE 2

Comparison of Standard and New HCR Configurations
Middle East VGO, Base Metal Catalyst System
73 vol. % Conversion <700° F.

| | Conventional | New |
|---|---|---|
| LHSV, 1/br | 0.75 | 0.75 |
| Catalyst Temperature, ° F. | 777 | 727* |

TABLE 2-continued

Comparison of Standard and New HCR Configurations
Middle East VGO, Base Metal Catalyst System
73 vol. % Conversion <700° F.

| | Conventional | New |
|---|---|---|
| HCR Zone Pressure, psig | 2300 | 1250 |
| Chemical $H_2$ Consumption, SCF/3 | 1800 | 1600 |
| Middle Distillate Yield, liquid volume % 250° F. to 700° F. | 67 | 68 |

*706° F. at equal gas/oil ratio for standard and new configurations

Table 2 indicates that yield is slightly improved in the current invention, as compared to the conventional configuration, at lower temperature, pressure and hydrogen consumption.

Figure 2:
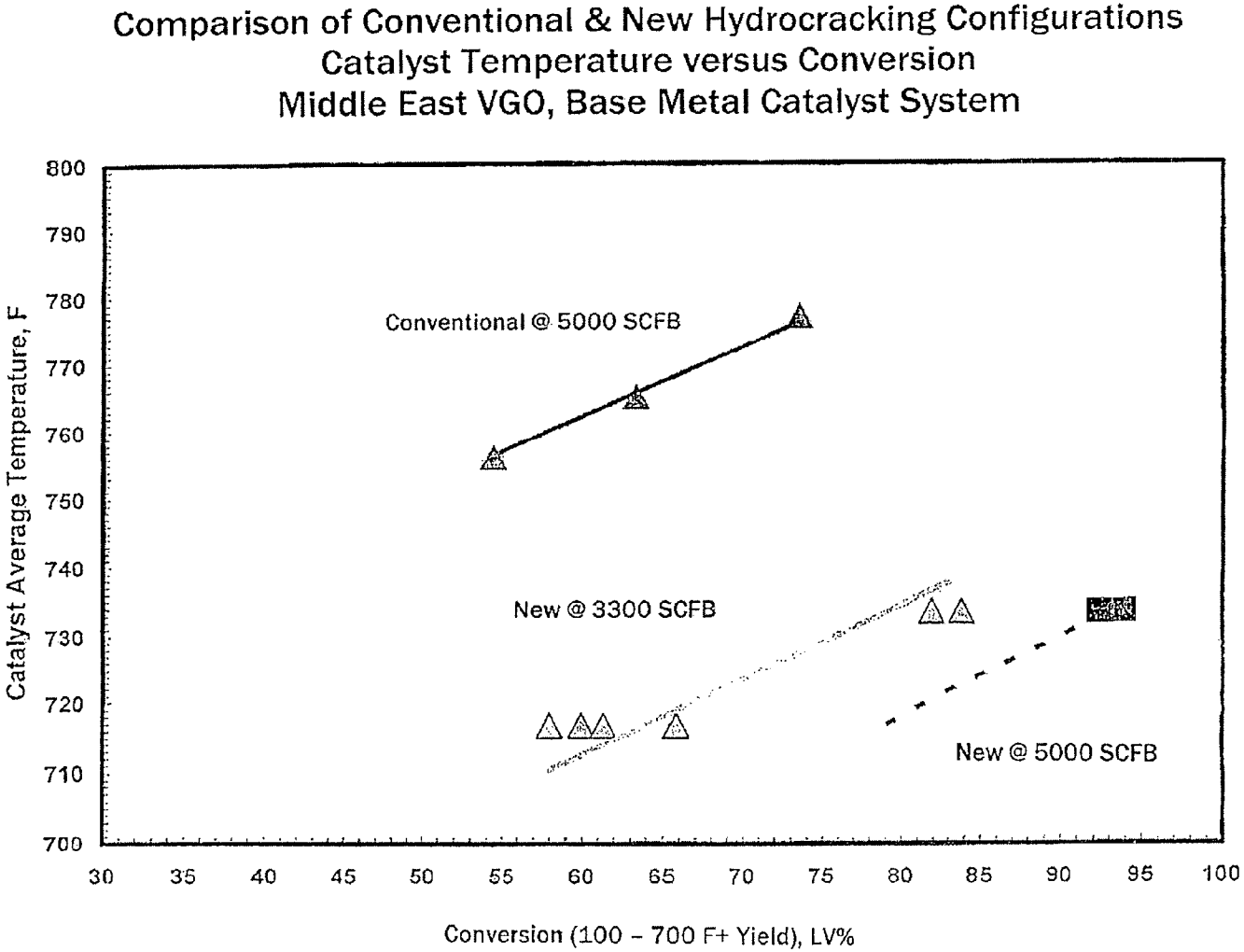
FIGS. 2 and 3 shows a comparison of conventional and new hydrocracking configurations using a base metal catalyst system.

FIG. 2 demonstrates that conversion in the instant invention is greater at lower temperatures, as opposed to the conventional hydrocracking configuration. Conversion improves at higher gas to oil ratios.

Figure 3:
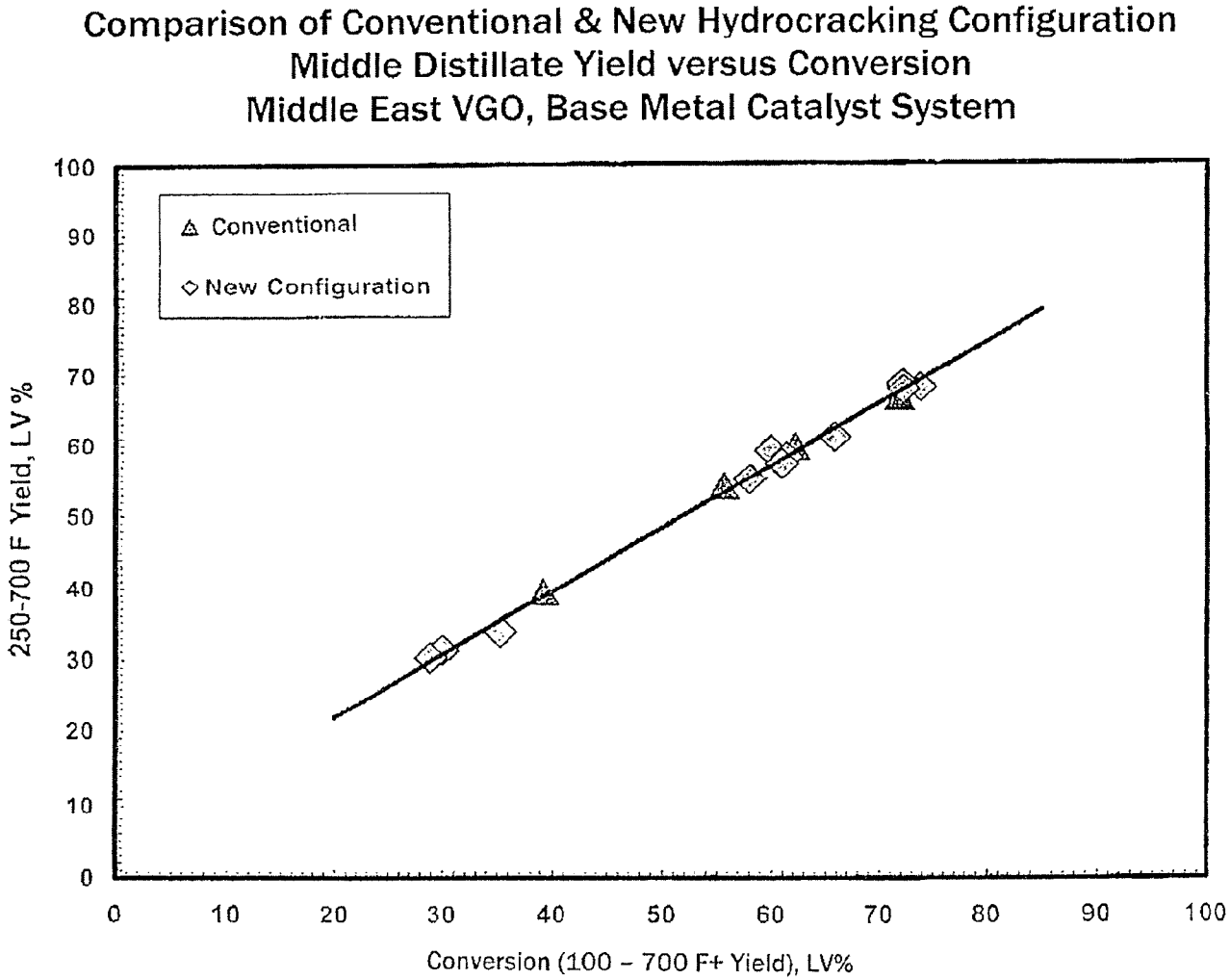

FIG. 3 demonstrates that yield to conversion ratios are comparable in both the conventional configuration as well as the configuration of the instant invention.

What is claimed is:

1. An integrated hydroprocessing method having at least two stages, each stage further comprising at least one reaction zone which comprises hydroprocessing catalyst, said method comprising the following steps:

(a) combining an oil feed with a hydrogen-rich gas stream to form a feedstock;

(b) passing the feedstock of step (a) to a reaction zone of the first stage, which is maintained at conditions sufficient to effect a boiling range conversion, and contacting it with hydroprocessing catalyst, thereby creating a hydroprocessed effluent, which is reduced in pressure, then heated to a constant temperature before proceeding to step (c);

(c) passing the effluent of step (b) to a very hot separator maintained at high pressure, where it is separated into an overhead fraction and a bottoms fraction;

(d) passing the overhead fraction of step (c) to a distillate upgrader which contains at least one zone of hydroprocessing catalyst and is maintained at conditions sufficient to effect a boiling range conversion, thereby creating an upgraded effluent;

(e) passing the bottoms fraction of step (c) to a reaction zone of the second stage, which is maintained at conditions sufficient to effect a boiling range conversion, and contacting it with hydroprocessing catalyst thereby creating a second hydroprocessed effluent;

(f) combining the upgraded effluent of step (d) with the second hydroprocessed effluent of step (e), the combined stream then entering a hot separator maintained at high pressure, in which the combined stream is separated into an overhead fraction and a bottoms fraction, the bottoms fraction proceeding to fractionation;

(g) passing the overhead fraction of step (f) to a cold separator maintained at high pressure, where it is separated into an overhead fraction comprising hydrogen and light gases, and a bottoms fraction comprising sour water.

2. The method of claim 1, wherein the overhead fraction of step (g) is passed through an amine absorber prior to passing to a recycle gas compressor.

3. The method of claim 1, in which material to be upgraded and hydrogen may flow co-currently or countercurrently to each other in the distillate upgrader of step (d).

4. The method of claim 1, in which the first stage reaction zone comprises at least one bed of catalyst selected from the group consisting of hydrotreating catalyst, hydrocracking catalyst or a combination of both, either alone or in combination with each other, and the second stage reaction zone comprises at least one bed of hydrocracking catalyst.

5. The method of claim 4, wherein the hydrocracking catalyst of the second stage comprises a base metal, base metal combination, a noble metal or a noble metal combination.

6. The method of claim 1, in which at least a portion of the upgraded effluent of step (d) is combined with the bottoms fraction of step (c) and passed to the reaction zone of the second stage.

7. The method of claim 3, in which the distillate upgrader comprises aromatic saturation catalyst when counter-current flow is occurring.

8. The method of claim 7, in which the aromatic saturation catalyst comprises a noble metal or combination of noble metals.

9. The method of claim 1, in which the feedstocks possess a boiling point of at least 392° F.

10. The method of claim 9, wherein the oil feed is selected from the group consisting of vacuum gas oils (VGO), heavy coker gas oil (HCGO), heavy atmospheric gas oil (AGO), light coker gas oil, visbreaker gas oil (VBGO), demetallized oils (DMO), vacuum residua, atmospheric residua, deasphalted oil, Fischer-Tropsch streams, Light Cycle Oil, Light Cycle Gas Oil and FCC streams.

11. The method of claim 1, in which the products comprise middle distillate fractions boiling in the range of from 250° F. to 700° F.

12. The method of claim 11, in which the products comprise naphtha, jet fuel, diesel and kerosene.

13. The method of claim 1, in which interbed hydrogen quench is used in stage one.

14. The method of claim 1, in which hydrotreating conditions comprise a reaction temperature between 400° F. to 900° F., a pressure between 500 to 5000 psig, a feed rate (LHSV) of 0.5 to 20 hr-1 (v/v); and overall hydrogen consumption 300 to 2000 SCF per barrel of liquid hydrocarbon feed (63.4 to 356 $m^3/m^3$ feed).

15. The method of claim 1, in which hydrocracking conditions comprise a reaction temperature of from 400° F. to 950° F. reaction pressure ranges from 500 to 5000 psig, and LHSV ranges from 0.1 to 15 hr-1 (v/v), and overall hydrogen consumption ranges from 500 to 2500 SCF per barrel of liquid hydrocarbon feed.

16. The process of claim 1, wherein the very hot separator of step (c) is a flash drum.

* * * * *